United States Patent [19]
Hogg
[11] 4,317,555
[45] Mar. 2, 1982

[54] NON DESTRUCTABLY REMOVABLE ADHESIVE BACKING STRIP AND ARTICLE SECURING DEVICE UTILIZING SAME

[75] Inventor: James W. Hogg, Nashville, Tenn.

[73] Assignee: Anchor Wire Corporation, Goodlettsville, Tenn.

[21] Appl. No.: 97,145

[22] Filed: Nov. 26, 1979

[51] Int. Cl.[3] ..... A47F 7/14
[52] U.S. Cl. ..... 248/467; 428/42; 428/537
[58] Field of Search ..... 248/205 A, 467, 489; 428/42, 537

[56] References Cited

U.S. PATENT DOCUMENTS

| | | | |
|---|---|---|---|
| D. 18,538 | 8/1888 | Williamson | 248/489 X |
| 1,814,303 | 7/1931 | Finlay | 248/205 A X |
| 2,486,593 | 11/1949 | Gardner | 248/205 A X |
| 3,023,991 | 3/1962 | Fisher | 248/467 X |
| 3,128,072 | 4/1964 | Shibata | 248/205 A X |
| 3,261,126 | 7/1966 | Marks | 248/205 A X |
| 3,350,045 | 10/1967 | Mayers | 248/467 X |
| 3,633,865 | 1/1972 | Hogg | 248/467 |
| 3,885,768 | 5/1975 | Frye | 248/467 |
| 4,003,538 | 1/1977 | Frye | 248/205 A X |
| 4,106,741 | 8/1978 | Hogg | 248/467 |
| 4,181,553 | 1/1980 | Hogg | 248/467 X |

*Primary Examiner*—William H. Schultz
*Attorney, Agent, or Firm*—Fisher, Christen & Sabol

[57] ABSTRACT

A backing sheet for use with objects which are to be adhesively attached to a surface includes a sheet of water-degradable material, such as paper, having a water-soluble adhesive coating on one side, a portion of one margin being inwardly slit. The object to be attached is secured, by adhesive or otherwise to the other side of the backing sheet and the backing sheet is secured to the surface by means of the water-soluble adhesive so that when the object is to be removed the delamination of the backing strip is completed by tearing from the slit portion so that the remaining portion and its adhesive may be removed by application of water.

11 Claims, 7 Drawing Figures

FIG. 1
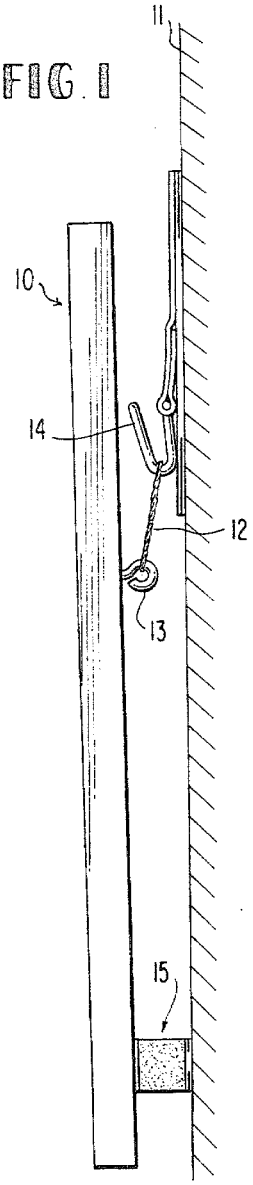
FIG. 2
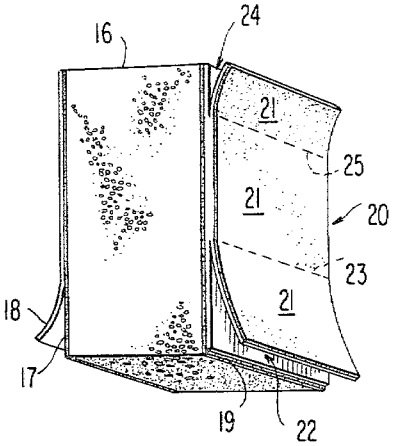
FIG. 3
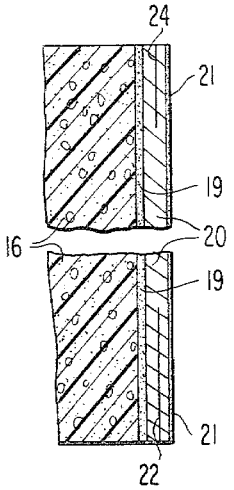
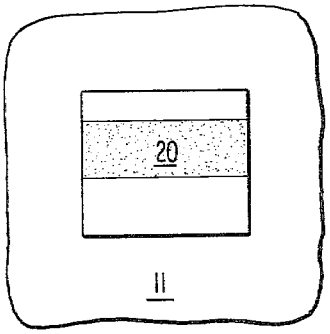
FIG. 4
FIG. 5
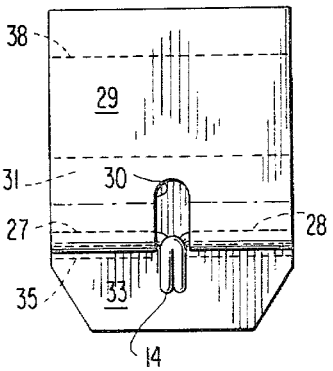
FIG. 6
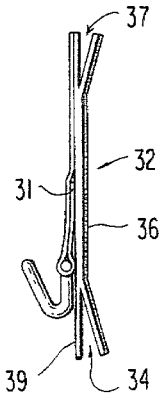
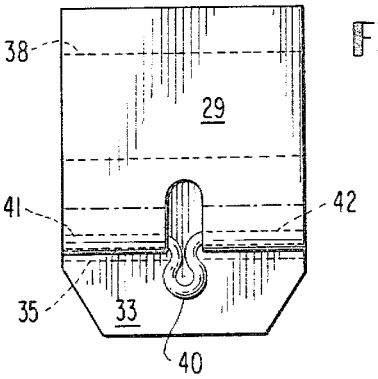
FIG. 7

NON DESTRUCTABLY REMOVABLE ADHESIVE BACKING STRIP AND ARTICLE SECURING DEVICE UTILIZING SAME

REFERENCE TO PRIOR PATENT

This invention is an improvement over the invention disclosed and claimed in any prior U.S. Pat No. 4,106,741.

FIELD OF THE INVENTION

This invention relates to articles used for suspending objects such as pictures, pennants, plaques etc. upon a wall, or otherwise displaying such objects on a wall, and more particularly to an article of this type which can be non-destructively removed from the wall when no longer needed.

SUMMARY OF THE PRIOR ART

When an object, such as a framed picture, is suspended from a single hook attached to a wall by means such as a wire attached to the two sides of the picture frame there is difficulty in positioning the picture so that it will remain level because, if the hook is not connected at the exact center of the wire the picture will no remain in a level position, even if it is initially positioned properly. Over a period of time, normal vibration of the wall or dusting the frame by the housewife will cause the picture to tilt if the hook is not centered.

A solution to the problem is to use a spacer at one, or both, of the lower corners of the picture, one surface of the spacer being adhesively secured to the picture frame, the other surface being adhesively bonded to the wall. In this way, the picture will remain in the position in which it was originally hung. Spacers of this type are disclosed in U.S. Pat. Nos. 2,492,411 to Barnes et al; 2,574,152 to Lewis et al, and 3,350,045 to Mayers. In the Barnes et al patent, a pressure-sensitive adhesive is used but it is well known that such adhesives are difficult to remove completely, and if the picture is moved to another position, an unsightly residue of adhesive will remain. In fact, if the spacer is applied to wallpaper, it is almost impossible to remove the spacer without removing some of the wallpaper. This is particularly true with adhesives strong enough to hold the frame firmly. The pressure sensitive adhesive migrates into the wall paper forming a permanent bond. In the Lewis et al and the Mayers patent a water-soluble adhesive is used but, due to the presence of the spacer material itself it is difficult, if not impossible to apply water to the adhesive coating in order to separate the spacer from wall surface, once the spacer has been applied.

Another solution of this problem of removal has been to coat only a portion of the surface of the object which may later be removed with an adhesive. This provides an uncoated portion which, presumably, may be grasped to facilitate removal of the object, for example a spacer, leaving only the adhesive behind. However, the adhesives used are either unsuitable for removal from the surface for which the spacer is used, or do not have sufficient strength for continued use. Examples of this type of article are disclosed in U.S. Pat. Nos. 2,030,135 to Carpenter; 2,432,987 to Garner; 2,486,593 to Gardner; 3,311,339 to Frye and 3,885,768 to Frye.

Another example of a strippable article is disclosed in U.S. Pat. No. 3,275,469 to Streit, in which a web, or strip, of paper is first coated with a layer of hydrophobic composition to which layer is then applied to a water-soluble adhesive. However, the composition of the intermediate hydrophobic layer must be carefully chosen so that the bond between that layer and the paper is greater than the bond between the intermediate layer and the water-soluble adhesive so that when the paper is to be removed it, and the intermediate layer, can be peeled away from the adhesive. This means that the full strength of the water-soluble adhesive cannot be utilized. It also increases the cost of a mere "notion" type item. Another, more complex, variation of this type of article, but using pressure-sensitive adhesive is disclosed in U.S. Pat. No. 4,003,538 to Frye.

SUMMARY OF THE PRESENT INVENTION

A purpose of the present invention is to provide a flexible backing sheet which can be used to adhesively attach two objects together in such a way that at some later date they may be separated and at least with respect to the surface of one of the objects all traces of the adhesive bond may be easily removed.

A preferred embodiment of the invention comprises a resilient spacer member, or pad which is coated on one side with a pressure-sensitive adhesive for securing the pad to the corner of a picture frame or perhaps directly to the back side of a pennant to be mounted on a wall. This adhesive may be temporarily provided with a protecting cover sheet to be peeled off prior to use. The other side of the pad is adhesively bonded to the front surface of a flexible backing sheet, preferably of paper. The rear surface of the backing sheet is coated with a water-soluble adhesive which is in a dry form prior to use. It is immaterial what type of adhesive is used to coat the front and back of the pad, but the backing sheet is partially delaminated over a certain portion of its marginal area during manufacture so that when it is desired to remove the pad, the process of delamination is completed by tearing the backing sheet apart over its entire area. The advantage of this arrangement is that only about one-half of the thickness of the paper backing sheet remains in place to be dissolved away, with the adhesive, by the application of water. In addition, because the paper sheet is torn apart the individual fibers are pulled out of place opening up "pores" in the surface which causes a more expeditious absorption of water. While it is true that this delamination of the backing sheet reduces the effective area of the bond represented by that portion of the backing sheet which remains integrally formed, nevertheless the total strength of the bond is not substantially reduced because the strength of the adhesive bond between the entire area of the exposed surface of the backing sheet and a wall surface is about the same as the internal strength of the partially delaminated backing, especially if it comprises a material, such as kraft paper.

As a precaution against an occasional tendency of the backing sheet to adhere too firmly to another paper surface, such as wallpaper, and to cause stripping of small sections of the backing sheet may be ensured by an inward slitting of the sheet along a marginal portion opposite to the location of the first-mentioned slit. When this is done, the tearing action begun at the first slit will be completed at the opposite slit without any chance that a piece of the underlying paper will be torn away.

While the backing sheet just described is primarily designed for use with a resilient spacer, it may also be applied to the back side of a hanger of the type disclosed in my prior U.S. Pat. No. 4,106,741, in which a wire, formed in the shape of a hook, or an eye is supported by a piece of sheet material folded upon itself. When the backing sheet of this invention is adhesively secured to the back of the sheet material supporting the wire element the hanger may be removed from a surface to which it has been adhesively applied by the same sequence of operations described in connection with a spacer. In this case, merely remove the frame, grasp the hook or eye for convenience, and pull apward.

Other similar applications of the backing sheet herein disclosed and claimed will be evident to those skilled in the art.

BRIEF DESCRIPTION OF THE DRAWINGS

FIG. 1 is a side elevation of a preferred type of spacer and hanger provided with a backing sheet made in accordance with this invention;

FIG. 2 is a perspective view, on an enlarged scale, of the spacer shown in FIG. 1;

FIG. 3 is a cross-section on a still larger scale of a fragmentary section of the construction of the backing sheet;

FIG. 4 is a front elevation of the portion of the backing sheet remaining on a surface after the front portion of the sheet has been torn off;

FIGS. 5 and 6 are respective front and side elevations of the hook shown in FIG. 1, and;

FIG. 7 is a front elevation of a modification in which an eye has been substituted for the hook of FIGS. 5 and 6.

DETAILED DESCRIPTION OF THE PREFERRED EMBODIMENTS

In the drawings, the numeral 10 indicates generally an object, such as a framed picture, suspended from a wall surface 11 by means of a conventional wire 12, secured to a pair of eyes 13 screwed into the side frame members, the wire being looped over a wire hook 14 which is adhesively attached to the wall by means which will be described later.

In addition, in order to overcome the tendency of the picture to become tilted from the horizontal, one or more pads, indicated generally by numeral 15, may be adhesively attached to the back of the picture 10 and also to the wall 11. These pads are usually placed at the opposite lower corners, primarily to prevent tilting or other displacement of the picture, while the weight of the picture is primarily supported by the hook 14. However, certain lighter weight articles, such as pennants or an ornamental article mounted on heavy cardboard, may be attached to a wall by the use of a number of pads 15 placed at intervals over the rear surface of the object to be put in place.

The construction of a pad 15 is shown in detail in FIGS. 2 and 3, where it can be seen that a rectangular block of a resilient foamed, or cellular plastic material 16 is provided on one of its smooth vertical surfaces with a coating of an adhesive 17, such as a pressure sensitive material which, in turn, is overlaid with a protective sheet 18, which may be waxed paper, or any other flexible material which can be easily peeled away without removing any of the adhesive 17. On the opposite smooth surface of the block 16 there is also applied a pressure sensitive adhesive coating 19 to which is applied a sheet of a water-degradable material 20. Examples of suitable materials include paper, especially kraft paper in either the bleached or unbleached varieties, paper, and liner board-type paper having a thickness of approximately 0.006 inch or more. The outer surface of the sheet 20 is coated with a liquid activated adhesive, such as a water-soluble animal adhesive, vegetable based adhesive or combination animal-vegetable adhesive, it being understood that an animal-based adhesive is preferred because of its shorter set-up time.

Either prior to attaching the paper strip 20 to the block 16, or after it is in place, it is partially delaminated by cutting into it longitudinally from at least one margin to produce a slit 22 which, when the paper is in place, extends from the bottom up to a line 23 parallel to the bottom margin. The purpose of this margin is to allow easy removal of the pad by tearing the paper 20 apart. However, depending upon the strength of the adhesive 21 and the comparative strength of the wall surface to which the pad has been attached, the possibility exists that when that portion of the paper above the slit 22 is torn apart a portion of the wall surface may come off with it. For that reason, it is preferable to cut a second slit 24 into the opposite margin of the paper which extends inwardly to the line 25 which is somewhat closer to the margin whereby the slit 22 is deeper than slit 24. The purpose of the slit 24 is to ensure that only the paper sheet 20 is delaminated when it is pulled away and torn from the bottom.

The result is that a thin layer of the strip 20 remains adhered to the wall 11 (see FIG. 4) and, since the paper 20 is liquid-degradable it can be removed by the application of water which will also remove the water soluble adhesive 21, leaving the wall surface undamaged.

While the block 16 is shown and described as being made of a resilient material, it acts primarily as a spacer in the preferred example and for that reason, its resilience allows it to accommodate to angular variations between the frame 10 and wall 11. If the device is used as the principal support the block 16 could be made of any suitable material, and be of any thickness. In fact, for some purposes, block 16 could be eliminated and the adhesive layer 17 and protective sheet 18 could be applied directly to sheet 20.

The supporting hook 14 is shown in detail in FIGS. 5 and 6 and is a variation of the hook disclosed and claimed in my prior U.S. Pat. No. 4,106,741, in which a length of wire is shaped in the form of a hook 14 terminating in two supporting arms 27 and 28 extending outwardly from the hook in opposite directions. The hook is supported by means of a sheet of paper, or thin metal 29, having a suitable opening 30 through which the hook 14 may project when the lower portion 31 of sheet 29 is folded around and under the arms 28 and is secured in place by adhesive, or other means, against the back of the sheet.

In this modification a backing sheet 32 is thereafter adhesively applied to the back of sheet 29, including the upwardly folded portion 31. A portion 33 of the backing sheet may extend below the fold so as to prevent the hook 26 from defacing the wall surface. As in the case of the previously described modification, backing sheet 32 should be composed of a material which is water-degradable and which, in its dry state, has sufficient tensile strength to sustain the weight of whatever is to be supported by hook 14. Similarly the sheet is inwardly slit, as at 34 upwardly from the lower margin for a short distance terminating at a location represented by the broken line 35 parallel with the lower margin of the sheet. The entire rear surface is also covered with a water-soluble adhesive 36, as described previously, either before, or after, the slitting of the paper is done. Thus, when the adhesive 36 is moistened and the entire assembly is pressed against the wall 11, the hook 14 will be retained in suspended position ready for use when the adhesive has set.

However, especially if the wall 11 is covered with wallpaper, it is preferable to provide a second slit 37 across the width of the upper portion of sheet 32 opposite to slit 34 and extending downwardly to a location represented by the broken line 38. As previously stated, the provision of a second slit in the backing paper 32 in the margin opposite to the margin which contains the initial delaminating slit, ensures that when tearing is begun, by pulling outwardly on the free flap portion 39 at the bottom of the backing strip, it will continue upwardly through the paper until it reaches the line 38 at which point the delaminating is completed by slit 37 and there is practically no likelihood that the path taken by the tearing of paper will extend to the edge of the upper margin and thereafter cause a portion of the underlying wallpaper to be torn away. What then remains of the backing strip 32 adhered to the surface of wall 11 can be removed by soaking the paper with water causing it to disintegrate and the adhesive 36 to go into solution to be wiped off with the water.

FIG. 7 illustrates a further modification which is similar in all respects to the modification shown in FIGS. 5 and 6, except that the connector member comprises a length wire formed in the shape of an "eye" 40, having free ends 41 and 42 extending outwardly in opposite directions to lie within the fold of the sheet of material 29. The partially delaminated sheet 32, slit upwardly to the broken line 35 is applied in the same manner as in the hook form of FIGS. 5 and 6, and the application to a wall surface and removal therefrom, are undertaken in the same way.

I claim:

1. Means for adhesively attaching two objects together for non-destructive detachment comprising:

a backing sheet of water-degradable fibrous material having sufficient tensile strength when dry to resist relative displacement between said two objects in the plane of said backing sheet when the objects are adhesively joined together by said sheet;

both surfaces of said backing sheet being coated with adhesive compositions, the adhesive composition on one of the surfaces being water-soluble;

said backing sheet being partially delaminated along a portion of its marginal edge by an inwardly directed slit in a plane disposed between said adhesively coated surfaces;

whereby after said backing sheet has been attached to the surface of one of said two objects by activation of said water-soluble adhesive, said objects may be separated by completing said delamination by tearing the backing sheet into two pieces.

2. The invention defined in claim 1, wherein said backing sheet is also slit inwardly from a portion of its marginal edge spaced oppositely from said first partial delamination in order to facilitate complete delamination when delamination by said tearing is continued.

3. The invention defined in claim 2, wherein said backing sheet comprises paper.

4. The invention defined in claim 3, wherein said backing sheet is rectangular.

5. An article to be used in hanging an object on a wall comprising:

a first element to be connected to said object;

a backing sheet of water-degradable material;

one face of said backing sheet being secured to a surface of said first element by an adhesive composition;

the other face of said backing sheet being coated with a water-soluble adhesive;

said backing sheet being partially delaminated inwardly from oppositely spaced marginal portions;

whereby when said backing sheet has been adhesively secured to another surface, said first element may be separated from said another surface by initiating tearing of the backing sheet at one of said marginal portions and completing said tearing at the other marginal portion.

6. The invention defined in claim 5, wherein said first element comprises:

a block of resilient material having, when unstressed, two generally parallel planar surfaces;

one of the planar surfaces being adhesively secured to the backing sheet;

the other of the planar surfaces being coated with an adhesive.

7. The invention defined in claim 6, wherein said last-mentioned adhesive is of the pressure-sensitive type and is overlaid with a removable sheet of protective material.

8. The invention defined in any one of claims 5, 6 or 7, wherein said block of resilient material, when unstressed, resembles a parallelepiped.

9. The invention defined in claim 5, wherein said first element comprises:

a strip of flexible sheet material, at least a portion thereof being folded backwardly and upwardly upon itself;

the major portions of the overlapping areas of the strip being adhesively joined together to provide a horizontally extending open space above the fold;

an elongated wire element disposed within said open space, said wire element being medially deformed to provide a depending support for an object;

said depending support projecting through an aperture provided in said strip.

10. The invention defined in claim 9, wherein said wire element is medially deformed to provide a hook.

11. The invention defined in claim 9, wherein said wire element is medially deformed to provide an eye.

* * * * *